United States Patent [19]

Barnay

[11] Patent Number: 4,751,939

[45] Date of Patent: Jun. 21, 1988

[54] IMMERSED HYDRAULIC UNIT FOR CONTROLLING AN UNDERWATER OIL WORKING STATION

[75] Inventor: Gilles Barnay, Montardon, France

[73] Assignee: Societe Nationale Elf Aquitaine (Production), Courbevoie, France

[21] Appl. No.: 822,830

[22] Filed: Jan. 27, 1986

[30] Foreign Application Priority Data

Jan. 29, 1985 [FR] France ..... 85 01177

[51] Int. Cl.[4] ..... F04B 39/00

[52] U.S. Cl. ..... 137/176; 137/172; 137/236.1; 137/567; 417/414

[58] Field of Search ..... 137/81.2, 236.1, 557, 137/558, 567, 172, 173, 176; 417/414

[56] References Cited

U.S. PATENT DOCUMENTS

| | | | |
|---|---|---|---|
| 3,202,167 | 8/1965 | DeYoung et al. | 137/173 |
| 3,517,815 | 6/1970 | Bolton et al. | 210/256 |
| 3,572,032 | 3/1971 | Terry | 60/52 |
| 3,764,233 | 10/1973 | Strickland | 417/414 |
| 4,052,852 | 12/1977 | Hart | 60/478 |
| 4,324,534 | 4/1982 | Sharkey | 417/414 |

FOREIGN PATENT DOCUMENTS 2120282 8/1972 France .

*Primary Examiner*—Alan Cohan
*Assistant Examiner*—John Rivell
*Attorney, Agent, or Firm*—Poms, Smith, Lande & Rose

[57] ABSTRACT

A reservoir (1) filled with fluid communicates through a central opening 21 with the inside of a flexible bladder 22 isolating the contents of the reservoir from the sea environment and equilizing the pressure inside the reservoir with the external hydrostatic pressure. An internal dividing wall 2 divides the reservoir into two compartments, the central compartment 3 to which is connected a duct 12 for the expanded fluid and housing a pump 8 for discharge to the platform and for draining water and the annular peripheral compartment 4 housing the pumps 5, 6 for feeding the compressed fluid to the accumulators. The installation can be used as a self contained hydraulic unit or fluid storage reservoir when the pressurized fluid supply is provided from the surface.

14 Claims, 1 Drawing Sheet

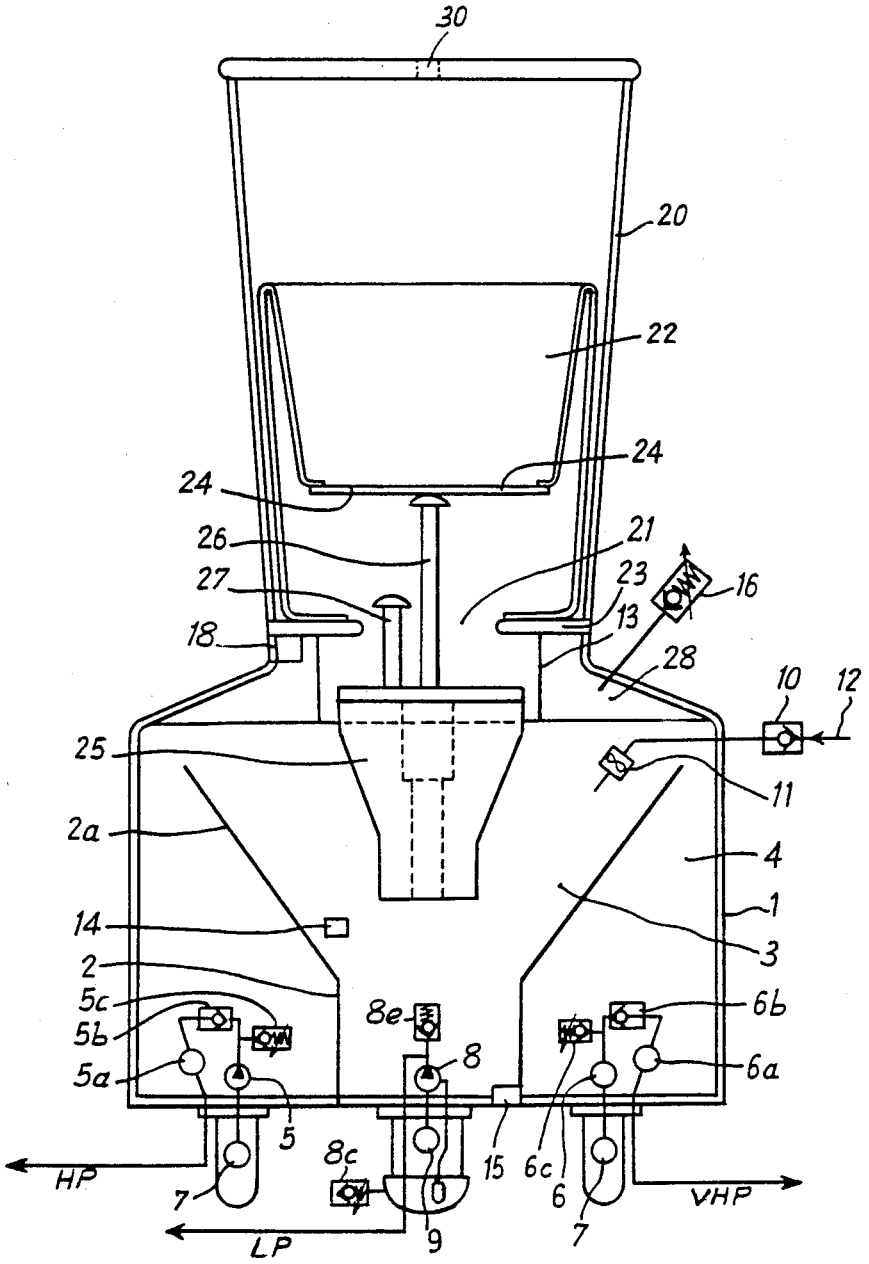
30
20
22
24
24
26
21
27
23
16
18
13
28
10
12
25
11
2a
4
1
14
3
2
5c
8e
6b
5b
8
5a
6a
5
8c
15
6c
HP
7
6
VHP
LP
9
7

IMMERSED HYDRAULIC UNIT FOR CONTROLLING AN UNDERWATER OIL WORKING STATION

The present invention relates to an immersed hydraulic unit for controlling an underwater oil working station. Underwater oil working stations, for example such as described in French patent No. 2 371 552 (U.S. Pat. No. 4,120,362) and in the French patent application No. 83 18458 (U.S. Ser. No. 673,477) in the name of the applicant, are designed for independent operation.

Their numerous parts, such as christmas tree valves, oil connection loops and manifold valves are remote controlled by means of electro-hydraulic circuits.

The mechanical energy comes from pressurized fluid accumulators immersed in the vicinity of or housed in the station itself, for example in the central control module.

The accumulators may be supplied with high pressure (HP) or very high pressure (VHP) hydraulic fluid, either exclusively from the surface platform, or from an immersed hydraulic unit, the failure of which must be palliated by an emergency supply from the surface.

After expanding at low pressure following controls carried out, the fluids flowing in a closed circuit must return towards the unit for recompression to the desired pressure. Before being sent to the unit, the low pressure (LP) fluid must have dissolved gases and accumulated water removed therefrom.

The purpose of the present invention is to provide an immersed hydraulic unit for an underwater oil working station, whose reservoir equipped with fluid compressors, fulfills the functions of an independent unit, but which may also, because of its means for detecting, separating and removing water and gases, serve if the need arises solely as low pressure fluid storage reservoir, when the pressurized fluid supply is provided from the surface.

The immersed hydraulic unit of the invention is characterized in that it comprises a fluid filled reservoir communicating through a central opening with the inside of a flexible bladder fixed to the top thereof and isolating the contents of the reservoir from the underwater environment, said reservoir being divided, by means of an internal, circular and coaxial dividing wall opening out upwardly, into two compartments, the central compartment to which a duct is connected for expanded hydraulic fluid having served for actuating members of the station and housing a pump for driving fluid to the surface platform and/or for draining water and the peripheral annular compartment, in which are housed pumps driving the compressed fluid towards the accumulators or directly towards the control members of the station.

Above the reservoir may be fixed an open bell at the top, inside which the bladder is placed, whose edge is fixed to an annular flange defining the central opening of the reservoir, said bladder contributing to balancing the pressure inside the reservoir with the external hydrostatic pressure and allowing the volume of the reservoir to be adjusted to the volume forming the fluid reservoir required for controlling the station.

Preferably, the bladder comprises in its central part a rigid disk cooperating with a level detector and an alarm contactor housed inside the reservoir.

The bottom of the central compartment may be formed as a decantation water trough having level detectors and the drainage pump.

Advantageously, the motors actuating the pumps are situated inside the reservoir so as to be cooled by the sea water.

A portion at the top of the reservoir comprising a baffle serves as gas trap and is provided with a gas presence detector, and a pressure reducer.

Other features of the invention will be clear from the following description of one embodiment given by way of example and illustrated by the single FIGURE;

Inside a reservoir 1 filled with fluid is placed a dividing wall 2 in the form of a funnel which is coaxial with respect to the reservoir and the outwardly opening part 2*a* of which promotes the rise of gas bubbles and the decantation of water. Dividing wall 2 separates the inside of reservoir 1 into a central compartment 3 and an annular peripheral compartment 4 which only communicate together over the dividing wall 2.

In the peripheral part 4 are housed two high pressure (HP) 5 and very high pressure (VHP) 6 pumps driven by motors 7 housed outside the reservoir 1 and cooled by the sea water.

The delivery sides of pumps 5 and 6 are connected by HP and VHP ducts to respective fluid accumulators not shown, with interpositioning of pressure sensors 5*a*, 6*a*, non return valves 5*b*, 6*b* and adjustable discharge valves 5*c*, 6*c*.

In the central compartment 3 are placed two water detectors 14 and 15 placed at different levels. A duct 12, driving back towards the reservoir the fluid having served for actuating the members of the station, opens into the upper part of the central compartment 3 through a non return valve 10 and a flow meter 11.

Because of the dividing wall 2 serving as decanter, the gases rise towards the top of the reservoir which is provided with a baffle 13 forming a gas trap 28, without penetrating into the peripheral compartment 4. Moreover, the drops of water run down to the bottom of the central compartment 3 which is provided with water detectors 14 and 15. The top of the reservoir forming the gas trap is provided with gas presence detectors 18 and a calibrated pressure reducing valve 16 allowing the gases to escape outside the reservoir.

In the vicinity of the bottom of the central compartment 3 is housed a low pressure pump 8 controlled by a motor 9 placed outside the reservoir. Pump 8 is connected on the delivery side by an LP duct, in which is fitted a discharge valve 8*e*. It serves for conveying the fluid to the surface or for drawing off the water detected by detectors 14 and 15. To the pump 8 is connected a duct having a valve 8*c* which serves as release valve between the surrounding environment and the fluid of the reservoir.

Since the hydraulic fluid flows in a closed circuit, the reservoir must comprise a device for balancing the pressure with the hydrostatic pressure of the sea environment. For this purpose, reservoir 1 has fixed thereon a bell 20 open at its top through an orifice 30, with which bell the inside of the reservoir communicates through a central opening 21. A flexible and deformable bladder 22, the inside of which also communicates with reservoir 1 through the central opening 21, is placed inside the bell 20 which hermetically isolates the inside of the reservoir from the sea environment.

The bladder or membrane 22 contributes to balancing the pressure inside the reservoir with the external hydrostatic pressure and allows the volume of the reservoir to be adjusted to the variable volume forming the fluid reserve required for controlling the underwater station.

The edges of its opening, through which the bladder communicates with the inside of the reservoir, are fixed to an annular flange 23 defining the central opening 21 and its side walls are applied against the inner walls of bell 20.

In its central part, bladder 21 comprises a rigid disk 24. There is placed axially inside the reservoir and on a base 25, a level detector 26 and an alarm contactor 27 cooperating with disk 24 for signalling the level of fluid filling the reservoir.

Should the motor and HP and VHP pump units fail, the emergency supply for the accumulators is provided by a surface hydraulic unit and, since the fluid flows in a closed circuit, the low pressure pump returns to the surface the fluid coming back from the station. The reservoir 1 then functions as a storage and water and gas separation reservoir.

I claim:

1. An immersed hydraulic unit for controlling an underwater oil working station including accumulators for fluid and station members to be controlled, characterized in that said unit comprises a fluid filled reservoir (1) communicating through a central opening (21) with the inside of a flexible bladder (22) fixed at its top and isolating the contents of the reservoir (1) from the underwater environment, said reservoir being divided, by means of an internal, annular and coaxial dividing wall (2) opening out towards the top, into two compartments, a central compartment (3) to which is connected a duct (12) for the expanded hydraulic fluid having served for actuating said members of the station and housing a first pump (8) for driving fluid towards a surface platform and/or for draining water and an annular peripheral compartment (4), in which are housed second and third pumps (5), (6) driving the compressed fluid towards the accumulators or directly towards the members of the station to be controlled.

2. The unit according to claim 1, characterized in that above the reservoir there is fixed a bell (20) open at the top, inside which the bladder (22) is placed, whose edge is fixed to an annular flange (23) defining the central opening (21) of the reservoir, said bladder contributing to balancing the pressure inside the reservoir with the external hydrostatic pressure and allowing the volume of the reservoir to be adjusted to the volume forming the fluid reserve required for controlling the station.

3. The unit according to claim 1 characterized in that the bladder (22) comprises in its central port a rigid disk (24) cooperating with a level detector (26) and an alarm contactor (27) housed inside the reservoir.

4. The unit according to claim 1 characterized in that the bottom of said central compartment (3) is formed as a decantation water trough having level detectors (14, 15) and the drainage first pump (8).

5. The unit according to claim 1, characterized in that said first, second and third pumps (5), (6), (8) are actuated by motors (7), (9) placed outside the reservoir and cooled with sea water.

6. The unit according to claim 1 characterized in that a portion at the top of the reservoir comprises a baffle 13 serving as a gas trap (28) and which is provided with a gas presence detector (18) and a pressure reducer (16).

7. An immersible hydraulic unit for controlling an underwater oil working station including accumulators for fluid and station means adapted to be controlled by actuating fluid, comprising in combination:

reservoir means for containing fluid and including a central opening;

a flexible bladder means in communication with said central opening and isolating fluid in said reservoir means from the underwater environment;

partition means in said reservoir means below said central opening dividing said reservoir means into two compartments, a first compartment located within said reservoir means, and a second compartment within said reservoir means disposed adjacent said first compartment;

said compartments being in communication with each other at the top of said partition means;

a duct means for returning expended fluid from actuated station members to said first compartment;

a first pump means in said first compartment for flow of pressure fluid therefrom;

and pump means in said second compartment for flow of actuating pressure fluid to said working station.

8. A unit as claimed in claim 7 wherein motors for driving said pump means in said compartments are located outside said reservoir means in the underwater environment.

9. A unit as claimed in claim 7 wherein said first pump means in said first compartment provides low pressure fluid; and said pump means in said second compartment provides high pressure actuating fluid.

10. A unit as claimed in claim 7 including means located within said reservoir means and cooperable with said bladder means responsive to and signalling the level of fluid in said reservoir means.

11. A unit as claimed in claim 7 including second duct means for flow of fluid from said first and second compartments to said station means wherein by a closed fluid circuit is provided.

12. A unit as claimed in claim 7 including baffle means adjacent said central opening of said reservoir means to form with said reservoir means a gas trap.

13. A unit as claimed in claim 12 including a gas detector in said gas trap.

14. A unit as claimed in claim 7 including water level detectors in said first compartment.

* * * * *